US006655401B2

(12) United States Patent
Sand et al.

(10) Patent No.: US 6,655,401 B2
(45) Date of Patent: Dec. 2, 2003

(54) MULTIPLE CHEMICAL PRODUCT EDUCTIVE DISPENSER

(75) Inventors: William F. Sand, Cincinnati, OH (US); Mark D. Dalhart, Mason, OH (US)

(73) Assignee: Hydro Systems Company, Cincinnati, OH (US)

( * ) Notice: Subject to any disclaimer, the term of this patent is extended or adjusted under 35 U.S.C. 154(b) by 99 days.

(21) Appl. No.: 09/962,507

(22) Filed: Sep. 25, 2001

(65) Prior Publication Data

US 2003/0056842 A1 Mar. 27, 2003

(51) Int. Cl.[7] ..... F04F 5/00

(52) U.S. Cl. ..... 137/1; 137/599.12; 137/625.47; 137/889; 137/892; 137/599.03

(58) Field of Search ..... 137/599.03, 599.12, 137/1, 888, 889, 892, 894, 625.11, 625.16, 625.47

(56) References Cited

U.S. PATENT DOCUMENTS

| | | | | |
|---|---|---|---|---|
| 2,593,733 A | | 4/1952 | Davies | |
| 2,719,704 A | * | 10/1955 | Anderson et al. | 261/18.1 |
| 2,881,800 A | * | 4/1959 | Bauerlein | 137/892 |
| 3,586,049 A | * | 6/1971 | Adamson | 137/625.41 |
| 3,785,391 A | | 1/1974 | Miller | |
| 3,942,685 A | | 3/1976 | Lindner | |
| 3,949,903 A | | 4/1976 | Benasutti et al. | |
| 4,226,267 A | | 10/1980 | Meacham, Jr. | |
| 4,294,285 A | | 10/1981 | Joslyn | |
| 4,458,708 A | | 7/1984 | Leonard et al. | |
| 4,523,854 A | | 6/1985 | Beckley | |
| 4,691,850 A | | 9/1987 | Kirschmann et al. | |
| 4,730,637 A | | 3/1988 | White | |
| 4,969,576 A | | 11/1990 | Merrill et al. | |
| 4,971,118 A | | 11/1990 | Cluff | |
| 5,014,211 A | | 5/1991 | Turner et al. | |
| 5,033,649 A | | 7/1991 | Copeland et al. | |
| 5,069,883 A | | 12/1991 | Matonte | |
| 5,105,851 A | | 4/1992 | Fogelman | |
| RE33,943 E | | 6/1992 | Arzberger et al. | |
| 5,255,820 A | | 10/1993 | Thomas | |
| 5,259,557 A | | 11/1993 | Spriggs et al. | |
| 5,584,327 A | | 12/1996 | Thomas et al. | |
| 6,283,385 B1 | * | 9/2001 | Beaver et al. | 239/10 |

FOREIGN PATENT DOCUMENTS

| | | |
|---|---|---|
| EP | 0467513 | 1/1992 |
| EP | 0544072 | 6/1993 |
| GB | 555875 | 9/1943 |
| WO | 9219530 | 11/1992 |

OTHER PUBLICATIONS

Auto–Chlor System "Automatic Dispensing Diverter Valve" 2 pg brochure, dated Feb. 1996, Memphis Tennessee.

* cited by examiner

*Primary Examiner*—Stephen M. Hepperle
(74) *Attorney, Agent, or Firm*—Wood, Herron & Evans LLP

(57) ABSTRACT

A dispenser selectively mixes one or more chemical fluids into a motive fluid such as water by using diverting motive fluid to one or more channels formed in an eductor body, at least one of the channels being an eductor. When the motive fluid passes through the eductor, a selected chemical fluid is eductively drawn into the venturi of the eductor, producing a mixed fluid having a desired total flow rate and dilution ratio. Additional dilution ratios, flow rates, and chemical fluids are selectable by diverting motive fluid to another channel or combinations of channels. Carry-over of chemical fluid between dispensing is avoided by diverting the motive fluid rather than by diverting the concentrated chemical fluid.

7 Claims, 7 Drawing Sheets

MULTIPLE CHEMICAL PRODUCT EDUCTIVE DISPENSER

BACKGROUND OF THE INVENTION

1. Field of the Invention

This invention relates to dispensers and more particularly to a chemical product selection and venturi eductor device for selectively dispensing and mixing, at a corresponding dilution ratio and total fluid flow rate, one of a plurality of fluids with another fluid.

2. Prior Art

Selector valves typically allow an operator to select and dispense one particular chemical fluid at a time, while closing off access to all of the other fluid sources available for selection. One such prior selector valve typically includes a static body having several inlet ports and one outlet port and a rotatable valve core with passages to allow selective connection of a selected inlet port with the outlet port. Sealing of the non-selected inlet ports is provided by a spring loaded, O-ring sealed plunger carried in the rotatable core and bearing against the face of the static body. While selector valves of this type allow for selective connection and dispensing of a plurality of fluids, they have several inherent disadvantages.

One problem associated with selector valves of this type is the ability to efficiently change over from one selected input chemical fluid to another. A residual volume of the prior chemical in many systems of this type must be purged prior to inputting a second selected chemical fluid. Purging the system is very detrimental in that it requires delays in the operation and diminishes the accuracy of the volume and timing of the mixing of the fluids. Because of the distance and the geometry of the path the selected fluid must travel within the selector valve system, the system may contain a significant amount of residual chemical after the user has selected a new inlet port, thereby requiring the user to spend time purging the line.

A contributing factor to the problem of residual fluids in the selector valve is turbulent flow of the fluids through the selector valve. Specifically, the cause of turbulent flow in the selected fluid flow path is commonly stagnation points or blind spots which are typically found at the juncture between mating components. These areas create turbulent flow of the fluid through the selector valve and minimize the ability to effectively purge the valve and flush the residual chemicals. Additionally, turbulent flow through the selector valve retards the fluid flow and requires greater pressures and timing problems for the selected input fluid sources and responsiveness of the selector valve and connected system components.

Two solutions to some of these identified problems are disclosed in U.S. Pat. Nos. 5,377,718 and 5,653,261 which are assigned to the assignee of the present invention. The systems of these patents reduce the amount of carry-over, or residual fluid, retained in the selector valve between dispensing selections by streamlining and reducing the volume of passages that retain residual fluid. Thus, in the illustrative embodiments contained therein, carry-over of less than 0.4 cc and less than 0.1 cc, respectively, are achieved.

While the systems disclosed in U.S. Pat. Nos. 5,377,718 and 5,653,261 solved a number of problems associated with prior selector valves, the systems were directed to reducing the amount of carry-over, and not to eliminating carry-over in the system. While many applications benefitted from the relatively small amount of carry-over, other applications were not suitable.

One specific prior art system avoiding chemical carryover is shown in FIG. 1. The dispensing system 10 uses two ball valves 12, 14, each directing a motive fluid, typically received from a pressurized water supply at a water inlet 16, to a respective eductor 18, 20. Thus, each selector valve 12, 14 does not direct or retain a chemical fluid. Instead, each chemical fluid is eductively drawn from a respective chemical fluid reservoir 22, 24 into the corresponding eductor 18, 20 downstream of the selector valve 12, 14, respectively, in response to the motive fluid. Mixed fluid from each eductor 18, 20 is dispensed from a common outlet 26. A third ball valve 28 supplies bypass water directly to the outlet 26 for purposes such as achieving a greater dilution, rinsing a hose (not shown) connected to the outlet 26, and rinsing articles (not shown).

While the dispensing system 10 efficiently mixes a number of chemical fluids for use from a single dispenser, further improvements are desired. For example, selecting a particular mixture requires positioning one or more of several different levers increases the opportunity for human error. In another example, use of several ball valves 12, 14, 28 increases the cost for selecting a chemical fluid, as compared to selector valves, such as disclosed in the above-referenced patents. In addition, a dispensing device be of a large size to position each ball valve and their levers.

Consequently, a significant need exists for a device for selectively mixing one or more of a chemical fluid with a motive fluid that is economic and smaller, yet does not carry-over chemical fluid between dispensing.

SUMMARY OF THE INVENTION

In accordance with principles of the present invention, in a preferred embodiment of the invention, a single selection member diverts a motive fluid to separate channels formed in an eductor body, at least one channel and preferably others being selectively and operatively associated with an eductor for drawing a chemical fluid. Thus, a single device is capable of selecting different mixed fluids without retaining a volume of residual fluid, or carry-over. A dispenser using the device can thus be smaller and more economically manufactured.

Consistent with one aspect of the invention, an apparatus for mixing at least one chemical fluid with a motive fluid has a selector body with a motive fluid passage and an eductor body with at least two fluid channels. Each fluid channel is in fluid communication between the motive fluid passage and a dispensing outlet. At least one fluid channel is an eductor whose venturi creates a low pressure when motive fluid passes through the eductor to draw a chemical fluid. Selecting the mixture of the motive fluid and the chemical fluid is achieved with a selector member that is contained within the motive fluid passage of the selector body to divert motive fluid to one or more of selected fluid channels. The single motive fluid selector member achieves an economy and efficiency over systems requiring a plurality of selector devices. In addition, since the selector member diverts motive fluid rather than a chemical fluid, carry-over of chemical fluids between dispensing selections is avoided.

In another aspect of the invention, a dispenser includes an apparatus with two eductors in the eductor body for mixing one of two chemical fluids, each supplied from a respective reservoir with a motive fluid; or alternatively for mixing the source chemical fluid from one or more sources but supplied at different flow rates. Also, different dilution rates may be produced by varying the flow rate of the motive fluid into the eductors. The selector member is positioned to divert motive fluid to at least one of the eductors to dispense the desired mixture.

Consistent with yet a further aspect of the invention, a method of mixing chemical fluids into a motive fluid without a carry-over of a previously selected chemical fluid includes the steps of (1) coupling a first supply of a chemical fluid to a venturi of a first eductor, (2) coupling a second supply of a chemical fluid to a venturi of a second eductor, (3) positioning a selector member to first position to divert the motive fluid to an inlet of the first eductor to dispense a first mixture, and (4) positioning the selector member to a second position to divert the motive fluid to an inlet of the second eductor to dispense a second mixture.

In short, prior art dispensing apparatus selected chemical sources by valves in the chemical lines. This invention contemplates a plurality of chemical eductors that are operated by a single valve in the motive fluid line diverting motive fluid to a selected eductor. Moreover, the motive fluid passage can be diverted to one or more chemical fluid channels connected to the same source to vary the dilution ratio of mixed fluid to be dispensed.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
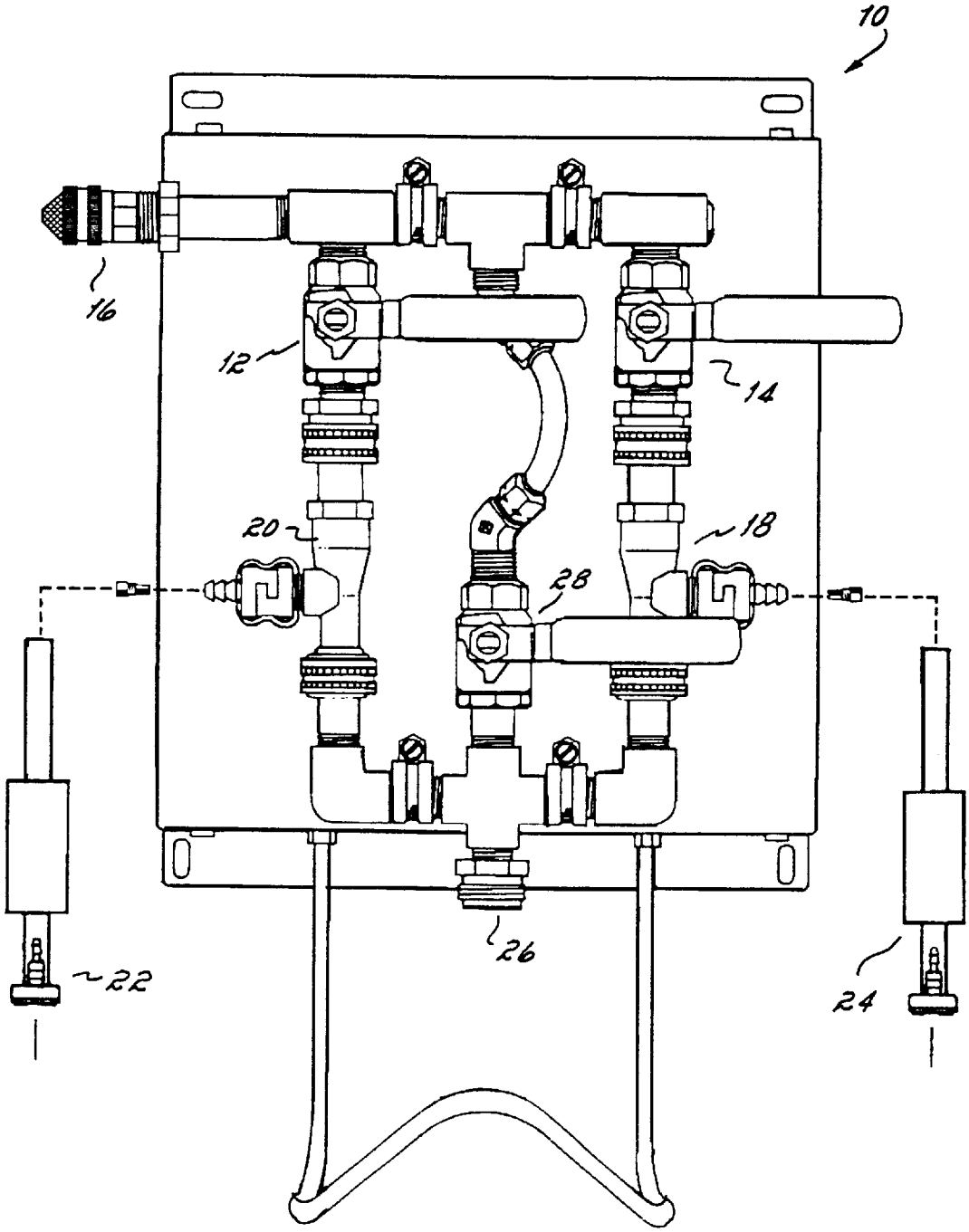
PRIOR ART FIG. 1
FIG. 1 is a cutaway view of a prior art dispensing system using three ball valves and two separate eductors to select between multiple chemical fluids for mixing.
Figure 2:
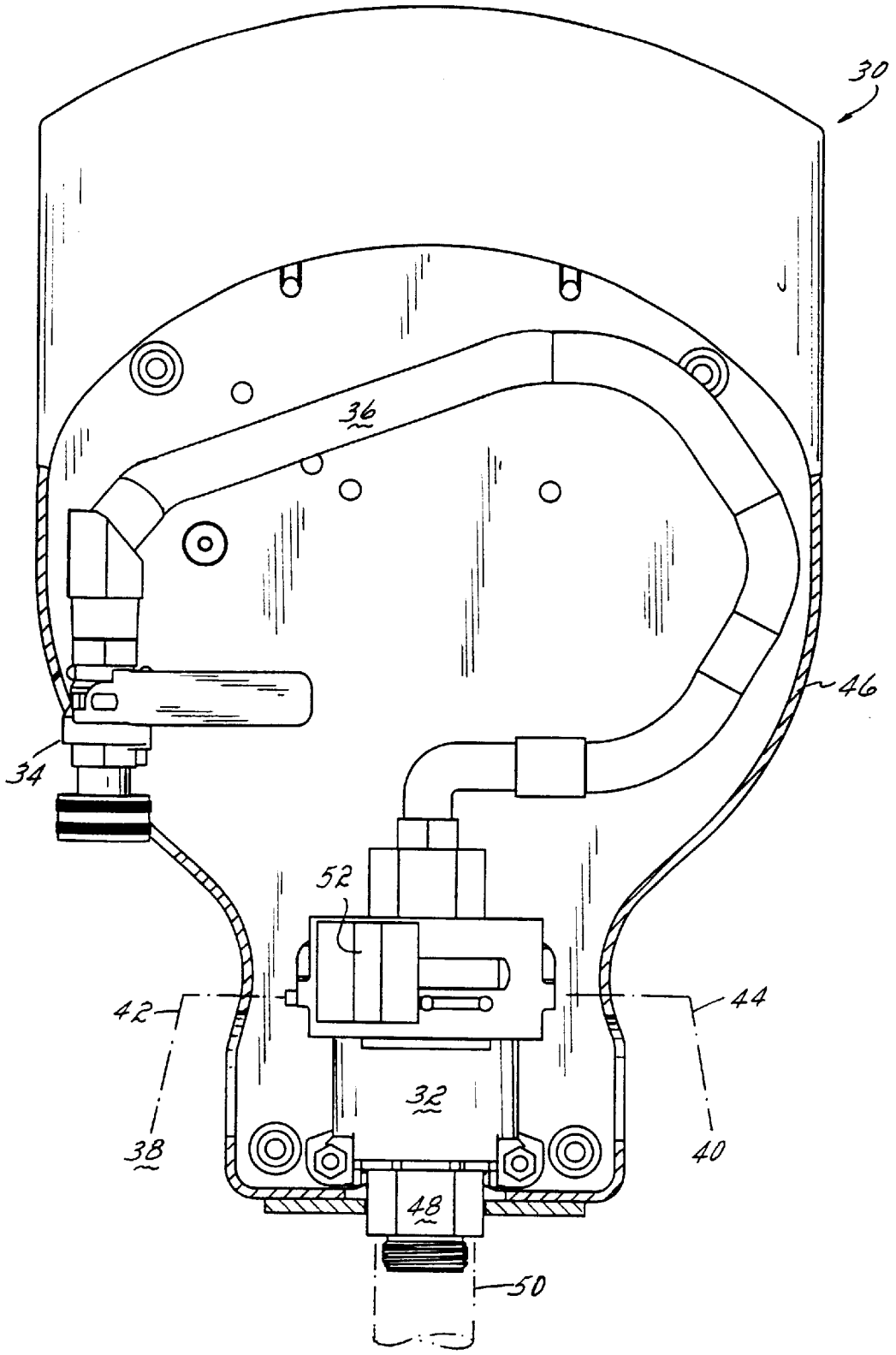
FIG. 2 is a cutaway view of a dispenser consistent with the present invention for selecting between two chemical fluids.

Turning to the Drawings, wherein like numbers denote like parts throughout the several views, FIG. 2 shows a dispenser 30 and includes a single device 32 for selectively educting one or more chemical fluids for mixing with a motive fluid. Examples of suitable applications for a dispenser 30 include dispensing chemical fluids such as concentrated detergents, glass cleaners, disinfectants, wetting agents, protective polymer polishes, etc., that are diluted to a desired dilution ratio by mixing with a motive fluid of pressurized water. It will be appreciated that other chemical fluids and motive fluids may be used which are consistent with aspects of the invention.

The motive fluid is received at an inlet valve 34, depicted as a ball valve, and passed through a motive fluid conduit 36 to the device 32 for mixing a selected chemical fluid, drawn respectively from chemical fluid reservoirs 38, 40 via chemical conduits 42, 44. The reservoirs 38, 40 may be mounted and contained within a cabinet 46 of the dispenser 30 or remotely positioned as shown.

Mixed fluids from the device are emitted from the dispenser through an outlet 48 and a hose 50 connected to the outlet 48. As will be discussed in greater detail below, the device 32 includes a plurality of pathways for selectively mixing the motive fluid with the chemical fluids, and thus applications consistent with the invention may include an outlet 48 divided into separate conduits for each pathway, as would be known to those skilled in the art.

The device 32 includes a single selection control, depicted as a lever 52, for selecting the mixing. Consequently, an operator need only move one control, simplifying use of the dispenser 30 and reducing the likelihood for error. In some applications, the selection control includes a position wherein no mixed fluids are emitted from the outlet 48, and thus the inlet valve 34 may be omitted or not routinely used.

Figure 3:
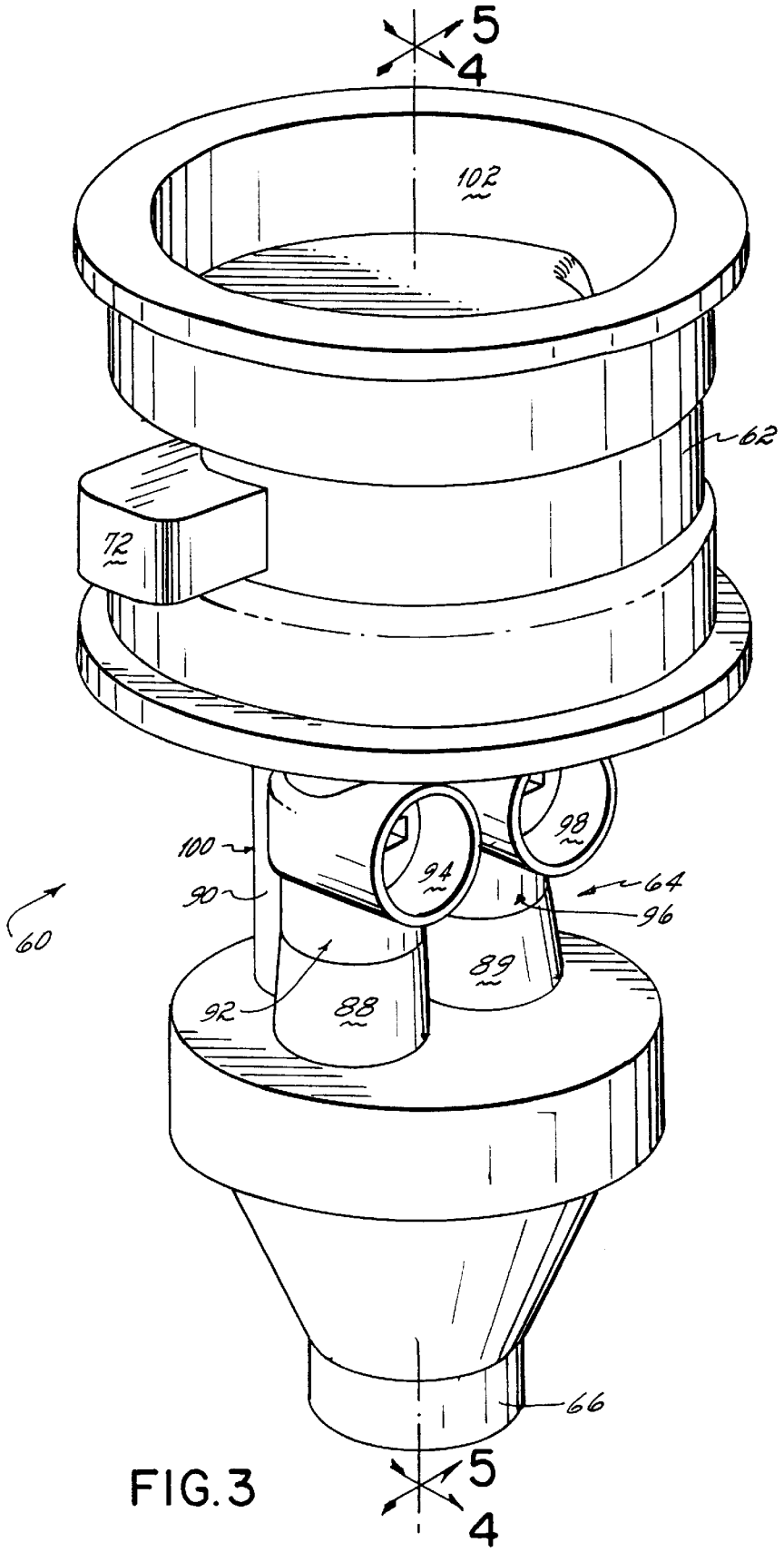
FIG. 3 is a perspective view of a first embodiment of the device shown in FIG. 2 for selecting and eductively mixing fluids.
Figure 5:
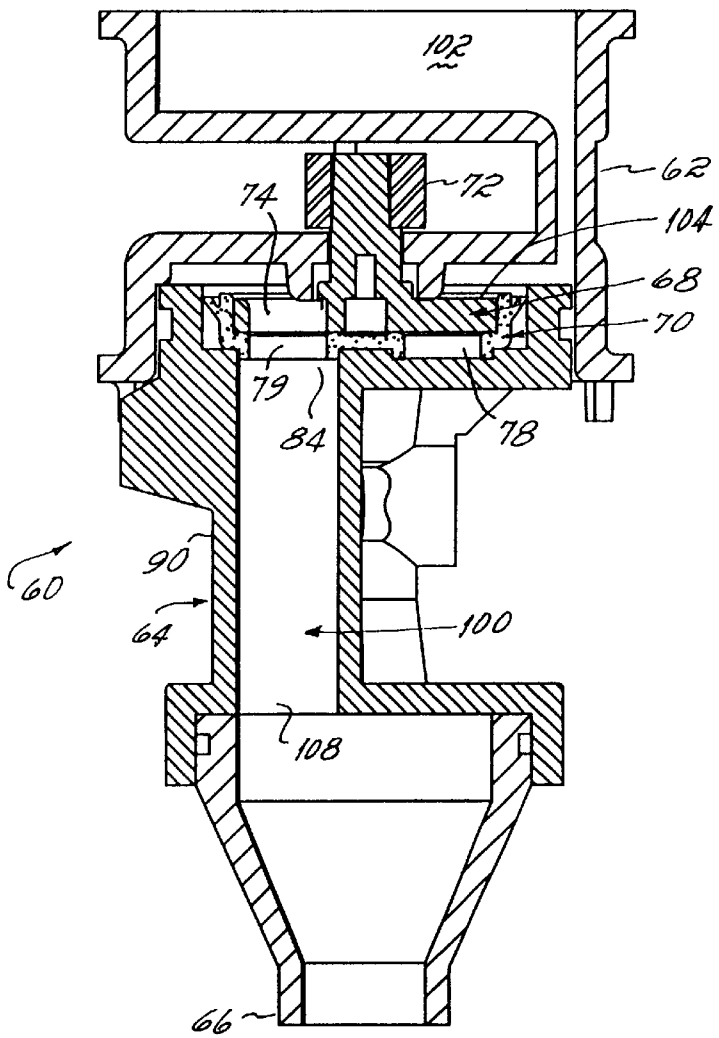
FIG. 5 is a cross sectional view along line 5—5 of the device of FIG. 3 showing fluid flow through the bypass channel.
Figure 4:
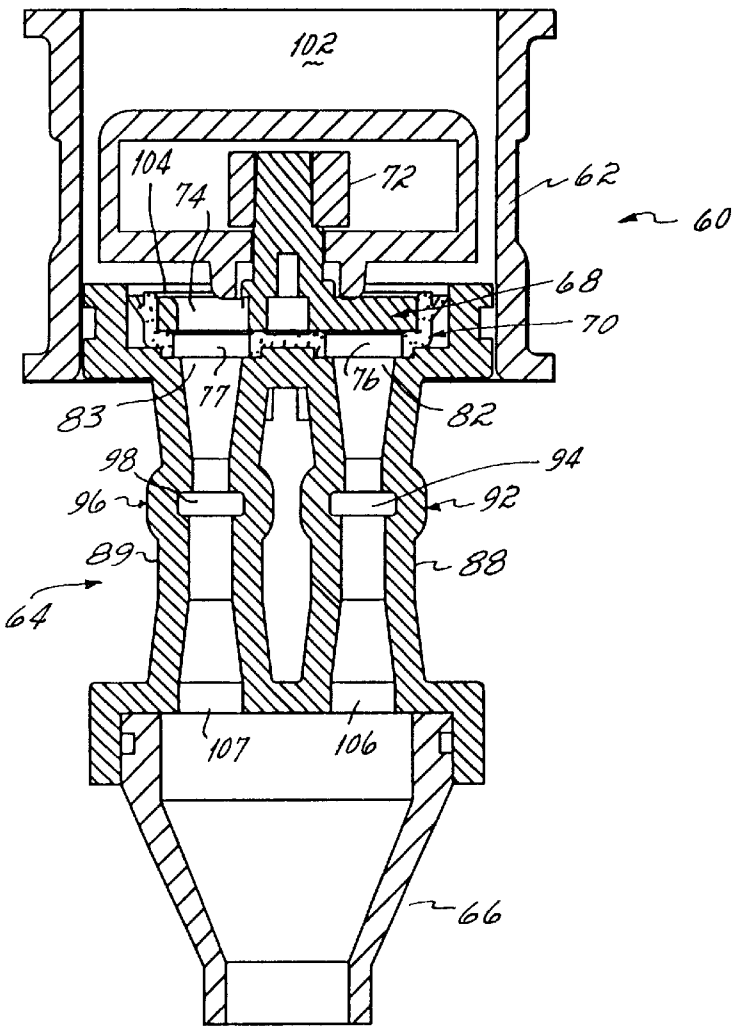
FIG. 4 is a cross sectional view along line 4—4 of the device of FIG. 3 showing fluid flow through the eductor channels.

FIGS. 3–5 depict a first embodiment of a selector disk device 60 for the dispenser 30 of FIG. 2. In particular, the device 60 is integrally formed from separately molded and attached components of a selector body 62, an eductor body 64, and an outlet 66. Between the selector and eductor bodies 62, 64, a selector disk 68 and selector seal 70 are contained.

With particular reference to FIG. 3, the selector disk 68 is rotated by an externally exposed lever 72 for angularly positioning a disk orifice 74 in the selector disk 68 to one of a plurality of sealed orifices 76, 77, 79 under the selector disk 68, which in turn are respectively registered to one of a plurality of inlets 82–84 in the eductor body 64. The eductor body 64 includes a plurality of fluid channels 88–90 that correspond to and include the inlets 82–84. In the illustrative depiction, there is no fourth inlet and no corresponding fluid channel. This allows the selector disk 68 to be positioned to an OFF position at a blind position.

With particular reference to FIG. 3, the first fluid channel 88 is illustratively depicted as a first eductor 92 that has a chemical fluid port 94 at the venturi of the eductor 92 for eductively drawing in a first chemical fluid. Typically, a metering tip (not shown) is inserted into the chemical port 94 for controlling the dilution ratio of the first chemical fluid, in coordination with the dimensional sizing of the first eductor 88. A chemical fluid conduit is connected to the metering tip and is inserted into a reservoir containing the chemical fluid (not shown). Alternatively, the chemical fluid conduit is inserted between the port 94 and the metering tip.

Similarly, the second fluid channel 89 is illustratively depicted as a second eductor 96 that has a chemical port 98 at the venturi of the eductor 96 for eductively drawing in a second chemical fluid. Typically, a metering tip (not shown) is inserted into the chemical port 98 for controlling the dilution ratio of the second chemical fluid, in coordination with the dimensional sizing of the second eductor 96.

The third fluid channel 90 advantageously illustrates a motive fluid bypass 100 sized for a desired flow rate of the motive fluid without any chemical fluid. It will be appreciated that the eductor body 64 is illustrative only and that various combinations of eductors and bypasses of various sizes may be selected for a specific application to achieve a desired flow rate, dilution ratio, and number of chemical fluids.

Figure 6:
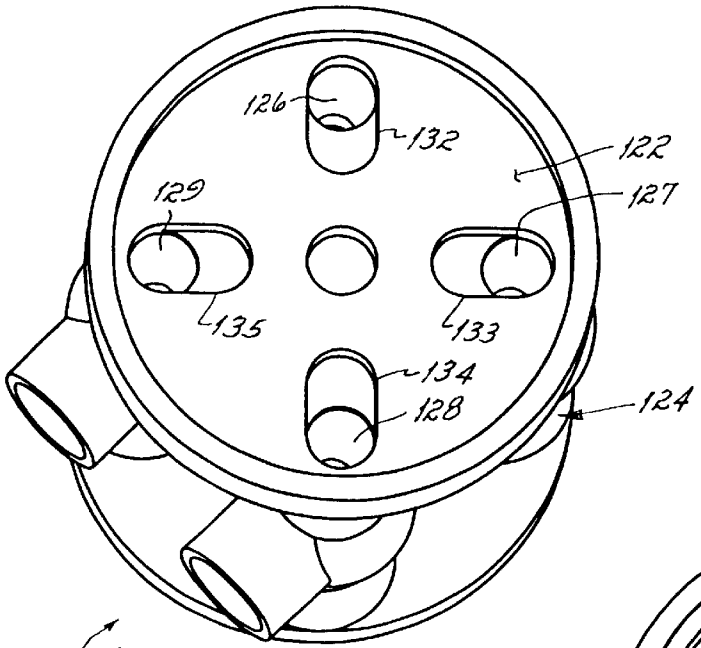
FIG. 6 is a perspective view of a second embodiment of the device shown in FIG. 2 for selecting and eductively mixing fluids with a selector member comprised of concentric rings, the concentric rings removed for clarity.

With particular reference to FIG. 5, a cross-sectional view of the device 60 of FIG. 3 depicts the fluid flow path with the selector disk 68 blocking motive fluid from entering the eductors 92, 96. With particular reference to FIG. 5, a cross-sectional view of the device 60 of FIG. 3 depicts the fluid flow path with the disk orifice 74 angularly aligned to divert motive fluid through the motive fluid bypass 100. In FIGS. 4, 5 the flow path through the device 60 begins with motive fluid passing through a motive fluid passage 102 formed in the selector body 62. The fluid flow is exposed to an upstream face 104 of the selector disk and passes through the disk orifice 74 into the eductor body 64. More particularly, in the illustrative depiction, the fluid flow passes into the third fluid channel 90, i.e., the motive fluid bypass 100. As shown in FIGS. 5 and 6, fluid flow is emitted from the eductor body at outlets 106–108, which are respectively part of the fluid channels 88–90. The emitted fluid flow is collected in the outlet 66 for dispensing through a hose (not shown in FIGS. 3–7).

Figure 7:
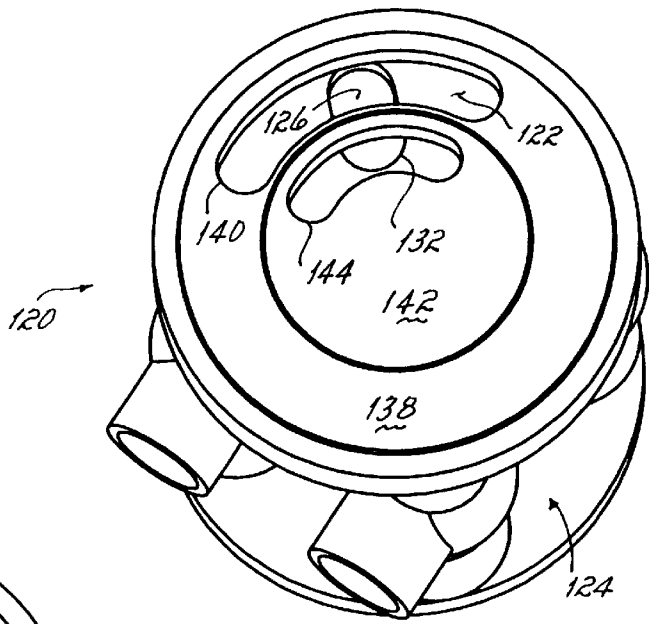
FIG. 7 is a perspective view of the device of FIG. 6 having concentric outer and inner selector rings positioned to select one of four channels.
Figure 8:
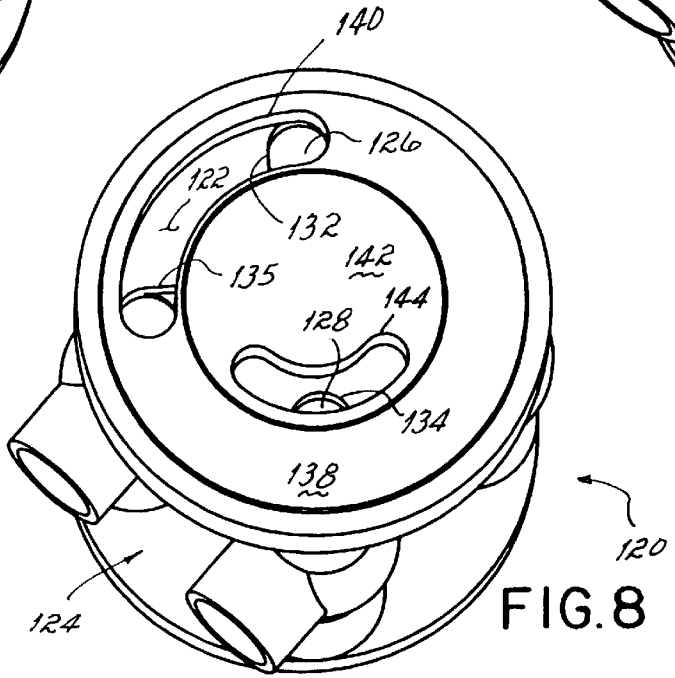
FIG. 8 is a perspective view of the device of FIG. 6 having the concentric outer and inner selector rings positioned to select four of four channels.

FIGS. 6–8 depict a second embodiment of a device 120 for the dispenser 30 of FIG. 2 that employs a concentric disk selection member 122 for diverting motive fluid. In the illustrative depiction, an eductor body 124 is similar to the previously described eductor body of FIGS. 3–5, other than having four fluid channels 126–129 rather than the previously described three. Thus, the device 120 does not have an OFF position. Instead, the device 120 has a selection member 122 capable of simultaneously selecting one, two, three or four fluid channels 126–129. Thereby, the device 120 is capable of mixing fluids to achieve different dilution ratios of the same chemical fluid or to simultaneously combine two or more chemical fluids with a motive fluid.

The combinations are selectable by radially elongated inlets 132–135 to the respective fluid channels 126–129. Then, an outer concentric selector disk 138, rotatably contained within the device 120, has an angularly elongated orifice 140 that can be angularly positioned to divert motive fluid to one or two inlets 132–135. Simultaneously, an inner concentric selector disk 142, rotatably constrained with the outer concentric selector disk 138, has an angularly elongated orifice 144 that can be angularly positioned to divert motive fluids to one or two inlets 132–135.

For instance, as illustrated in FIG. 7, each concentric selector disk 138, 142 are rotated to only expose one inlet 132, thus only one fluid channel 126 is selected. By contrast, as illustrated in FIG. 8, outer concentric selector disk 138 is angularly positioned to expose inlets 132, 135, thereby selecting fluid channels 126, 129. Inner concentric disk 142 is angularly positioned to expose inlets 134, 133, thereby selecting fluid channels 128, 127.

Figure 9:
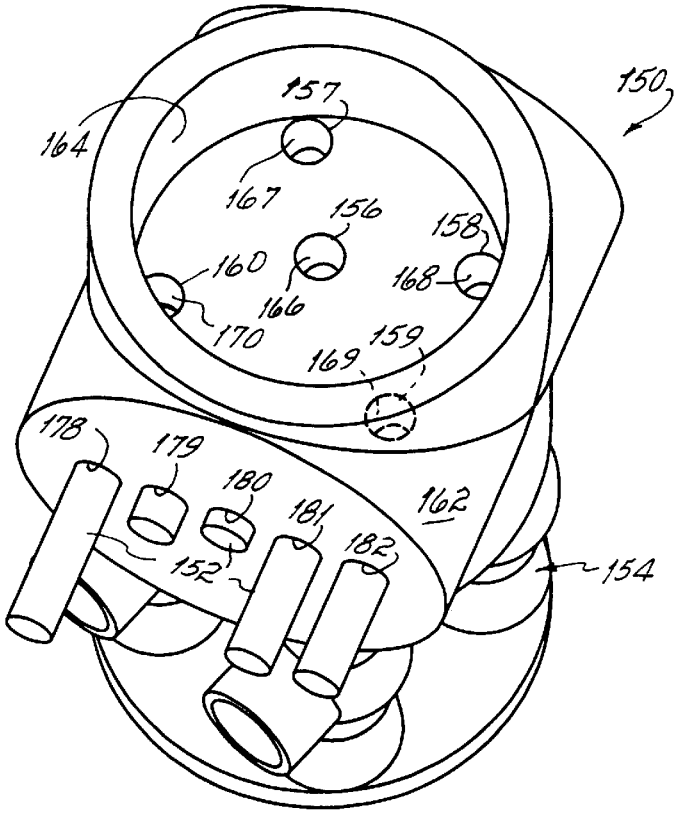
FIG. 9 is a perspective view of a third embodiment of the device shown in FIG. 1 for individually selecting channels with push buttons for eductive mixing.
Figure 10:
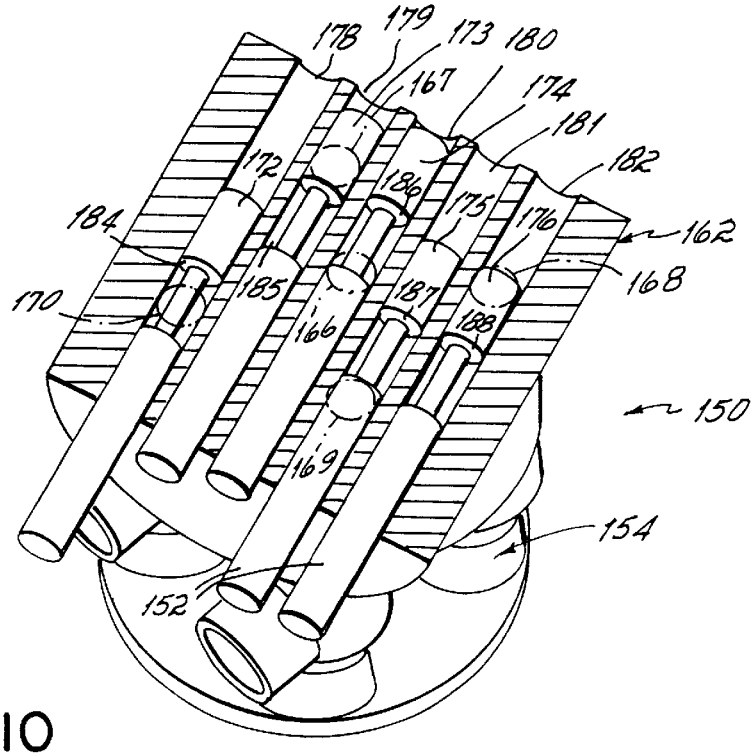
FIG. 10 is a cutaway view of the device of FIG. 9 showing spools positioned to selectively allow motive fluid to each channel in the eductor body.

FIGS. 9, 10 depict a third embodiment of a device 150 for the dispenser 30 of FIG. 2 that uses push button selection member 152 for diverting motive fluid. In the illustrative depiction, an eductor body 154 is similar to the previously described eductor bodies, except having a fluid channel 156 that is surrounded by four other fluid channels 157–160. A selector body 162 includes a motive fluid passage 164 that separates into vertically elongated inlets 166–170, each corresponding and vertically aligned with an assigned fluid channel 156–160. The selection member 152 traverses a plane that intersects or blocks each inlet 166–170. In particular, the selection member 152 includes a plurality of selection spools or lands 172–176, each traversing within a spool cavity 178–182, as shown in FIG. 10. Each land 172–176 includes a recessed portion 184–188 registered to align with the respective inlet 166–170 as the spool 172–176 traverses through the respective spool cavity 178–182.

Figure 11:
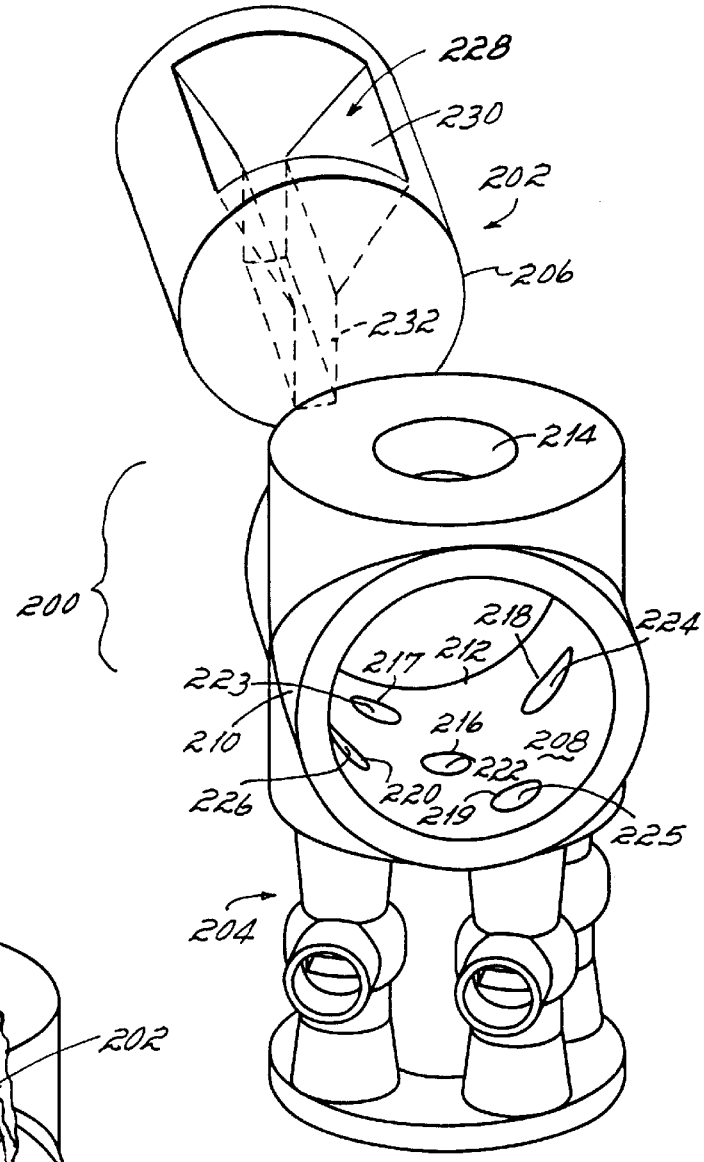
FIG. 11 is an exploded view, partially in section, of a fourth embodiment of the device shown in FIG. 1 for dialing a selector member comprised of a cylinder for selectively allowing motive fluid to a channel in the eductor body.
Figure 12:
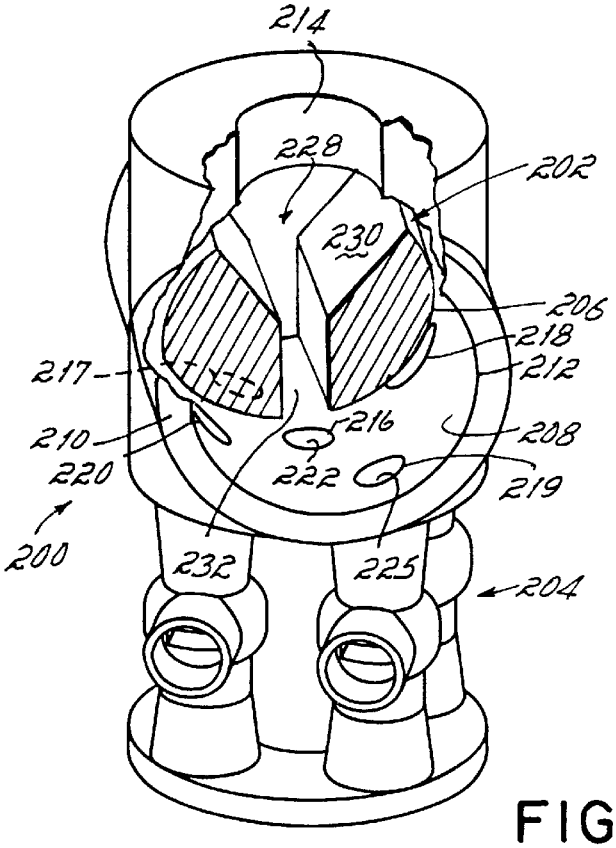
FIG. 12 is a cutaway view of the device of FIG. 11 showing the diversion channel, particularly in section, in the cylinder aligned with the bypass channel in eductor body.

FIGS. 11–12 depict a fourth embodiment of a device 200 for the dispenser 30 of FIG. 2 that uses a cylindrical selection member 202 for diverting motive fluid. In the illustrative depiction, an eductor body 204 is similar to the previously described eductor body of FIGS. 9–10. The selection member 202 differs in that its cylindrical outer diameter 206 is received within a cylindrical cavity 208 in a selection block 210. Along an inner diameter 212 of the cylindrical cavity 208, an opening 214 provides motive fluid and a plurality of inlets 216–220 direct motive fluid to respective fluid channels 222–226. The cylindrical selection member 202 includes a cylinder passage 228 that communicates between two portions of its outer diameter 206 to put the opening 214 into fluid communication with at least one of the inlets 216–220. For instance, as depicted in FIG. 12, the cylinder passage 228 has an angularly wide portion 230 that allows communication with the opening 214 when the cylindrical selection member 202 is at various angular positions. An angularly narrow portion 232 of the cylinder passage 228 that selectively aligns with one of the inlets 216–220, which are thus angularly spaced in the illustrative embodiment to select one at a time.

In use, a dispenser 30 mixes a selected chemical fluid when an operator positions a selection member, such as a selector disk 68, concentric disk selection member 122, push button selection member 152, and a cylindrical selection member 202. Thereby, the device 32 diverts motive fluid to one or more fluid channels, such as to the first eductor 92 that draws a first chemical fluid for mixing, to the second eductor 96 that draws a second chemical fluid for mixing, or to the motive fluid bypass 100. The selected fluids are then dispensed through an outlet 48 for uses, such as washing or for filling portable dispensing articles, such as spray bottles.

By virtue of the foregoing, a dispenser 30 is provided of reduced volume and reduced number of parts, especially when the plurality of fluid channels are formed within a unitary eductor body 64. Moreover, since the chemical fluids are eductively drawn, a passive device 30 is achieved that requires no active components to draw the chemical fluids, utilizing instead the motive force form the motive fluid (e.g., pressurized water supply). Also, since gravity is not used to direct the chemical fluids to the dispenser 30, a more flexible positioning and sizing of chemical fluid reservoirs 38, 40 is available. Yet, with the flexibility of chemical fluid selection, the single device 32 does not suffer from carry-over of one chemical fluid when changing selections.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A method of mixing chemical fluids into a motive fluid without a carry-over of a previously selected chemical fluid, comprising:

coupling a first supply of a chemical fluid to a venturi of a first eductor contained in an eductor housing coupling a second supply of a chemical fluid to a venturi of second eductor contained in said eductor housing:

selectively diverting the motive fluid to at least one of an inlet of the first eductor, to dispense a first mixture, and an inlet of the second eductor to dispense a second mixture: and selectively and simultaneously diverting motive fluid to an inlet of a motive fluid bypass and to the inlet of the first eductor to dispense the first mixture at an increased dilution ratio.

2. A method of mixing chemical fluids into a motive fluid without a carry-over of a previously selected chemical fluid, comprising:

coupling a first supply of a chemical fluid to a venturi of a first eductor contained in an eductor housing coupling a second supply of a chemical fluid to a venturi of second eductor contained in said eductor housing;

selectively diverting the motive fluid to at least one of an inlet of the first eductor, to dispense a first mixture, and an inlet of the second eductor to dispense a second mixture;

wherein the first and second supply are coupled to at least one supply of the same chemical fluid, said method including the further step of:

selectively diverting the motive fluid to at least one of the first and second eductors.

3. The method of claim 1 including dispensing said motive fluid and the first mixture through a common outlet chamber.

4. The method of claim 2 including selectively dispensing the first and second mixtures through discrete, separate outlets.

5. The method of claim 2 including a coupling of the motive fluid at different flow rates to at least one of said first and second eductors.

6. The method of claim 2 including diverting motive fluid simultaneously to said first and second eductors.

7. A proportioner for operably dispensing mixtures of motive fluid and chemicals, said proportioner having a plurality of eductors respectively operably connected to a plurality of respective chemical sources, said proportioner comprising:

a selector valve housing;

a common outlet chamber;

an eductor housing having an inlet end and an outlet end;

said eductor housing defining said plurality of eductors;

said eductor housing operably coupled at an inlet end to said selector valve housing and operably coupled at an opposite end to said common outlet chamber;

said plurality of eductors opening at discharge ends thereof into said common outlet chamber; and said eductor housing separating and spacing apart said selector valve housing from said common outlet chamber with said selector valve housing and said common outlet chamber mounted on said respective inlet and opposite ends of said eductor housing.

* * * * *